US010663260B2

(12) United States Patent
Choiniere

(10) Patent No.: US 10,663,260 B2
(45) Date of Patent: May 26, 2020

(54) LOW COST SEEKER WITH MID-COURSE MOVING TARGET CORRECTION

(71) Applicant: BAE SYSTEMS Information and Electronic Systems Integration Inc., Nashua, NH (US)

(72) Inventor: Michael J. Choiniere, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 301 days.

(21) Appl. No.: 15/817,842

(22) Filed: Nov. 20, 2017

(65) Prior Publication Data

US 2019/0154403 A1 May 23, 2019

(51) Int. Cl.

| | |
|---|---|
| ***F41G 7/22*** | (2006.01) |
| ***F41G 3/02*** | (2006.01) |
| ***F41G 7/00*** | (2006.01) |

(52) U.S. Cl.

CPC ..... *F41G 7/2206* (2013.01); *F41G 3/02* (2013.01); *F41G 7/007* (2013.01); *F41G 7/2253* (2013.01); *F41G 7/2293* (2013.01)

(58) Field of Classification Search

CPC ..... F41G 7/2206; F41G 3/02; F41G 7/2293; F41G 7/007; F41G 7/2253; F41G 7/303; F41G 7/2226; F41G 7/008; F41G 7/2286

See application file for complete search history.

(56) References Cited

U.S. PATENT DOCUMENTS 3,778,007 A * 12/1973 Kearney, II ..... F41G 3/02 244/3.14
4,179,088 A * 12/1979 French ..... F41G 7/2286 244/3.14
4,267,562 A * 5/1981 Raimondi ..... F41G 3/02 348/144

(Continued)

FOREIGN PATENT DOCUMENTS

FR 2893405 A1 * 5/2007 ..... F41G 7/303
GB 2543524 A1 * 4/2017 ..... F41G 7/2226

OTHER PUBLICATIONS

International Search Report, PCT/US18/61058, 15 pages, dated Feb. 7, 2019.

*Primary Examiner* — Bernarr E Gregory
(74) *Attorney, Agent, or Firm* — Davis & Bujold PLLC; Scott J. Asmus

(57) ABSTRACT

A targeting system for guidance correction of a projectile along a flight path toward a target. The targeting system includes seeker/guidance system mounted on the projectile which controls guidance of the projectile along the flight path toward the target. A remote fire control system receives and displays a survey image of a battlefield and enables an operator to mark location coordinates of the target in the survey image. Based on the location coordinates, the fire control system defines a reference image and transmits the reference image and location coordinates to the seeker/guidance system for use in guiding the projectile toward the target. If the target moves as the projectile travels toward the target, the remote fire control system enables the operator to update the location coordinates and transmit only an offset of the coordinates to the seeker/guidance system which then adjusts or corrects the flight path of the projectile.

20 Claims, 3 Drawing Sheets

(56) References Cited

U.S. PATENT DOCUMENTS

| | | | | | |
|---|---|---|---|---|---|
| 5,323,987 | A * | 6/1994 | Pinson | F41G 7/2253 | 244/3.16 |
| 5,379,966 | A * | 1/1995 | Simeone | F41G 7/303 | 244/3.11 |
| 5,458,041 | A * | 10/1995 | Sun | F41G 7/2226 | 244/3.11 |
| 5,495,540 | A | 2/1996 | Frankot et al. | | |
| 5,881,969 | A | 3/1999 | Miller | | |
| 6,157,875 | A * | 12/2000 | Hedman | F41G 7/2226 | 102/382 |
| 7,183,967 | B1 * | 2/2007 | Haendel | F41G 7/2206 | 342/195 |
| 7,338,009 | B1 * | 3/2008 | Bobinchak | F41G 7/2206 | 244/3.1 |
| 7,947,936 | B1 * | 5/2011 | Bobinchak | F41G 7/2206 | 244/3.1 |
| 8,084,724 | B1 * | 12/2011 | Brosch | F41G 7/008 | 244/158.1 |
| 8,106,340 | B1 * | 1/2012 | Diaz | F41G 7/008 | 244/3.1 |
| 9,121,669 | B1 | 9/2015 | Hyslop et al. | | |
| 10,012,477 | B1 * | 7/2018 | Ell | F41G 7/2253 | |
| 2011/0017863 | A1 | 1/2011 | Goossen et al. | | |
| 2011/0084161 | A1 | 4/2011 | Wallis | | |

* cited by examiner

LOW COST SEEKER WITH MID-COURSE MOVING TARGET CORRECTION

FIELD

The present disclosure relates to guidance systems and, more particularly, to a guidance system integrated with a fire control system for use with a projectile that facilitates mid-course correction of the intended target to compensate for movement of the intended target.

BACKGROUND

Semi-Active Laser (SAL) seeker systems are commonly used in military and domestic applications. For example, known SAL seeker systems can be utilized with guidance systems in connection with projectiles and function to direct the projectile at an intended target by means of a laser beam, e.g., semi-active radar or semi-active laser homing. With this technique, a laser is constantly pointed at the intended target and the laser radiation bounces off the target and is scattered in all directions. A projectile is launched near the intended target and, as the projectile approaches the area of the target, some of the laser energy, reflected by the intended target, is detected by laser seeker sensors carried by the projectile and used to determine which direction this energy is being reflected from. The sensors transmit data to an onboard guidance controller which, in turn, processes the data to determine the precise location of the intended target to be struck by the projectile. The onboard guidance controller then transmits guidance signals to adjust the orientation of the guidance wings attached to the projectile. The guidance wings are suitably controlled by the signals to guide the projectile at the intended target.

In a similar manner, projectiles can incorporate image type seekers which include optics and optical sensors that communicate with an onboard guidance controller and work in concert to detect the location of an intended target. The guidance controller processes the optical images/signals, received from the optics, during travel of the projectile and, in turn, transmits guidance signals to the deployed adjustable guidance wings which are suitably controlled so as to guide the projectile at the intended target.

Combinations of laser and image seekers are known which integrate both of these technologies and can increase the precision and accuracy of the seeker system, but are relatively expensive, complex and tend to be less reliable due to the increased number of parts such as high priced IMU-enabled GPS devices, for example, and high-performance processing requirements.

Generally, known ATR systems are autonomous and entirely mounted on and/or in the bodies of the projectiles. Such known ATR systems require expensive and complicated, seeker and guidance control systems for guiding the projectile or missile at a desired target. The known optical seeker systems communicate with the guidance control systems, by way of a processor that analyses the optical data or the pixel array of the optical image as viewed by the seeker optics as the projectile travels over the ground. By analyzing the optical data, the processor can identify a target, or a potential target, and determine the location of the pixel or pixels in the pixel array that have been identified as the target or the potential target. The processor then generates corresponding guidance signals, in a conventional manner that are transmitted to the guidance control system and its actuators. Depending on the guidance signals, the actuators control adjustable the wings or canards so as to guide the projectile at the intended target.

In known ATR systems, the associated processors are high-speed, high-performance processors which execute complicated algorithms in an attempt to accurately recognize and select a potential target, determine the location of the selected target and transmit guidance signals to the projectile guidance control system so as to guide the projectile at the selected target. Since the ATR system, in combination with the seeker and guidance control systems, are mounted on the projectile itself, they can only be utilized once before being totally destroyed upon engagement of the projectile with the intended target.

Because known projectile mounted seeker systems and onboard guidance controller systems are complex and expensive, due to the large amounts of data to be gathered and processed while traveling to an intended target, there is a need to simplify targeting systems while, at the same time enhancing performance of the targeting systems.

SUMMARY

Wherefore, it is an object of the disclosure to overcome the above mentioned shortcomings and drawbacks associated with the conventional systems and provide enhancements relating to targeting systems including seeker and guidance control systems.

Another object of the disclosure is to provide an image based targeting system having a seeker system which utilizes an optical reference image to recognize a "battlefield" and the location of an intended target on the battlefield and supply guidance signals to an onboard guidance control system which controls the guidance of the projectile at the location of the intended target. The projectile mounted image based seeker system also communicates with a remote fire control system that can repeatedly transmit updated target location information, to the onboard guidance control system, which, in turn, can repeatedly adjust the orientation of the adjustable wings or canards based on the reference image and the updated target location information.

Another object of the disclosure is to provide a targeting system and a method of operating the same to provide a projectile with a navigational reference image and an initial target location within that reference image such that following launch, the projectile can be directed toward the battlefield and the intended target using the initial target location and reference image as navigational aids. The targeting system includes an optical seeker system and a guidance control system that are mounted on the projectile and which control guidance of the projectile while the projectile is traveling enroute toward the battlefield and the intended target. The targeting system also includes a fire control system that receives one or more images/views of the battlefield and can display the images/views of the battlefield to an operator of the fire control system. The fire control system facilitating continued visual tracking of the current location of the intended target by the operator and repetitive updating of the target location in the event that the intended target moves within the battlefield. The fire control system can transmit the updated target location information to the guidance control system of the projectile so that the onboard guidance control system can repeatedly adjust the guidance of the projectile at the current location of the intended target. In this manner the course of the projectile can be repeatedly altered or "fine-tuned" while the projectile flies toward the intended target. With the targeting system according to the disclosure, the course of the projectile can be adjusted up until the projectile actually engages the intended target, i.e., the point of impact.

The disclosure also relates to a targeting system for course correction of guidance of a projectile along a course traveling toward an intended target. The targeting system comprises an onboard seeker/guidance control system that is mounted on the projectile for controlling guidance of the projectile along the course toward the moving target. The targeting system further has a fire control system that is located remote from the projectile and the onboard seeker/guidance control system. The remote fire control system comprises a first communication link that is connected to a display device, an input device and a processor. The first communication link can receive image signals of a desired survey area of the terrain and transmit the image signals to the display device which visually displays the survey images of the battlefield to the operator based on the image signals. The input device enables the operator to mark the intended target within a current one of the survey images. The processor of the fire control system determines an initial location of the intended target within the current survey image based on the location marked by the operation in the current survey image. The processor also defines a reference image that is smaller than the current survey image. The reference image essentially defines a smaller section or area, of the current survey image, and is based on the initial location of the intended target within the current survey image. That is to say, the initial location of the intended target, as marked by the operator, is used in determining a boundary or boarder of a smaller section or area, i.e., the reference image in the current survey image. The communication link of the fire control system transmits both 1) the reference image and 2) the initial location of the intended target to the seeker/guidance system.

The onboard seeker/guidance control system comprises a communication link that is connected to an onboard processor, an optical seeker system and a guidance control system. The communication link of the seeker/guidance control system receives at least the reference image and the initial location of the intended target. As the projectile travels, the optical seeker system observes the terrain and transmits corresponding signals to the onboard processor. The onboard processor then compares the terrain observed by the seeker system with the reference image to orient the projectile and determine an initial aim point with respect to the reference image based on the initial location of the moving target. The onboard processor transmits guidance signals, based on the initial aim point, to the guidance control system to guide the projectile or missile along a desired course toward the intended target.

If the intended target moves within the survey image, shown on the display device of the remote fire control system, the operator can then mark the new current location of the intended target again using the input device. Then the processor of the remote fire control system determines the new location coordinates of the moving target with respect to the reference image and determines the location offset(s) by comparing the new location of the intended target to the initial location of the intended target. Thereafter, the communication link of the remote fire control system transmits only the location offset to the onboard seeker/guidance control system. The communication link of the onboard seeker/guidance control system then receives the location offset and the onboard processor analyzes the initial aim point and the location offset with respect to the reference image to determine an updated aim point. The onboard processor then transmits updated guidance signals, which are based on the updated aim point, to the guidance control system for correcting the course of the projectile and now guiding the projectile toward the new current location of the intended target.

The remote fire control system could also employ ATR to track a target highlighted by the operator and determine the location coordinate's offsets as the target moves.

The disclosure also relates to a method of correcting a flight path of a projectile with a targeting system during mid-course of the projectile traveling toward an intended target. The method includes mounting a seeker/guidance control system of the targeting system on the projectile, controlling guidance of the projectile along the flight path toward the intended target with the seeker/guidance control system, and electrically coupling the seeker/guidance control system to an onboard communication link for receiving information; providing the targeting system with a fire control system having a communication link electrically coupled to a display device, an input device and a processor; receiving, with the communication link of the fire control system, a survey image in which the intended target is located, from a remote imaging device, and displaying the survey image on the display device; defining a reference image located within the survey image with the input device, and marking of location coordinates of the intended target located within the reference image with the input device; transmitting, via the communication link of the fire control system, at least the defined reference image and the location coordinates of the intended target to the seeker/guidance control system of the projectile for facilitating guidance of the projectile to an aim point of the projectile; and inputting, via the input device of the fire control system, revised location coordinates of the intended target to compensate for any movement or change of the intended target within the reference image, and transmitting, via the communication link of the fire control system, the revised location coordinates of the intended target to the seeker/guidance control system of the projectile and thereafter guiding, via the seeker/guidance control system, the projectile to a revised aim point of the projectile at the intended target.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

The system will be understood by reference to the following detailed description, which should be read in conjunction with the appended drawings. It is to be appreciated that the following detailed description of various embodiments is by way of example only and is not meant to limit, in any way, the scope of the disclosure.

The targeting system 2, according to the disclosure, will now be briefly described to provide a general understanding of the principal members of the targeting system 2 and their corresponding functions. Following this brief overview, the various components of the targeting system 2 will be discussed in more detail with reference to a detailed description of the operation of the targeting system 2.

Figure 1:
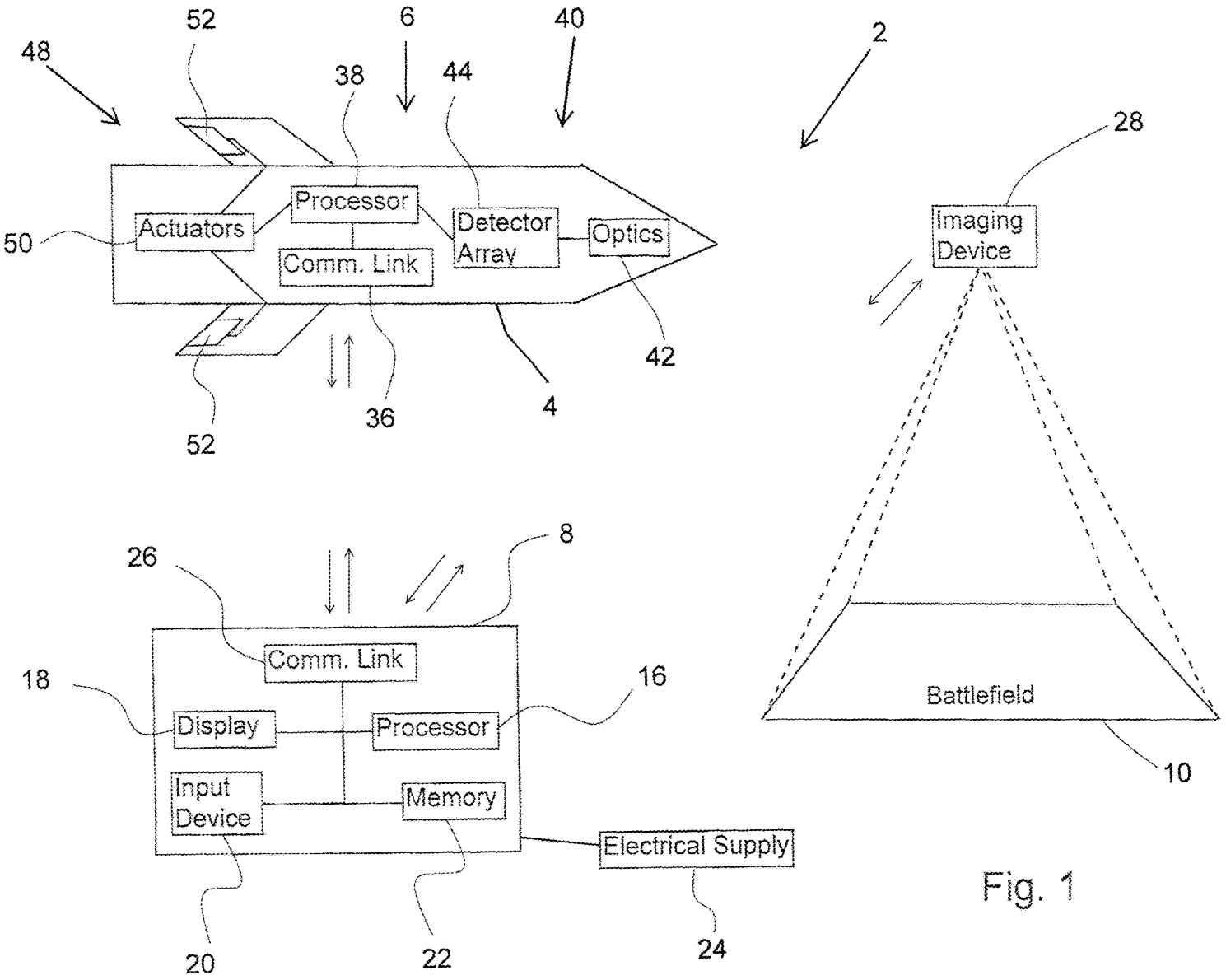
FIG. 1 is a diagrammatic view of an image based targeting system according to the disclosure.

As shown in FIG. 1, the targeting system 2 comprises two primary but independent components which communicate with one another to assist with deployment of a projectile 4 and continuous guidance of the projectile 4 at an intended target, and which facilitate adjustment or correction of the flight path of the projectile 4 as it travels toward that intended target. For the sake of simplicity and brevity, the targeting system 2 will be described in relation to a "projectile." However it is to be understood that the term projectile 4, as used within this disclosure, can mean a rocket, missile, bomb, grenade, weapon or ordinance. Essentially, the targeting system 2 can be utilized with any munition that has the capability of controlled travel or flight. As diagrammatically shown, the targeting system 2 includes a seeker/guidance control system 6 and a remote fire control system 8 that is separate and independent from the seeker/guidance control system 6.

The seeker/guidance control system 6 of the targeting system 2 has fewer components so as to reduce the costs associated with these single use features while enabling controlled guidance and course correction of the projectile 4 during flight. As an example, the software requirements on the seeker/guidance control system 6 are reduced which translates to less software licenses that are only used for a short duration. The licensed software would reside on the remote fire control system 8 that would not be destroyed and also be used to control multiple projectiles. The seeker/guidance control system 6 is mounted on the projectile 4 in a typical manner and functions to view the terrain over which the projectile 4 passes following launch thereof and assist with guiding the projectile 4 along a course at an intended target located within a battlefield 10. As used herein, mounted refers to mounting on or internal to the system. In contrast to known systems, the seeker/guidance control system 6 of the targeting system 2 guides the projectile 4 based on optical information/data obtained by the projectile 4 as well as an optical image and a minimal amount of target location information/data transmitted thereto, typically prior to launch, from the remote fire control system 8.

The remote fire control system 8 of the targeting system 2 according to one example is a remotely located unit (remote from the projectile 4 and the seeker/guidance control system 6 mounted thereon) that enables an operator 12 to visually select a desired target located within an acquired optical image, determine corresponding target location information/data and transmit the optical image and target location information/data to the seeker/guidance control system 6 mounted on the projectile 4. Upon receipt of the optical image and target location information/data by the seeker/guidance control system 6, the projectile 4 can then be launched and guided, based on the optical image and target location information/data, to the selected intended target. In an advantageous manner, the remote fire control system 8 enables the operator 12 to visually watch for any movement of the selected intended target, following the launch of the projectile 4. If the intended target does move after the projectile 4 is launched, the remote fire control system 8 enables the operator 12 to simply identify the new current location of the intended target, within the optical image (repeatedly if necessary depending target movement). The remote fire control system 8 then transmits only the updated current target location information/data to the seeker/guidance control system 6 which, in turn, determines the corresponding changes in the target location information/data and adjusts guidance of the projectile 4 at the new current location of the intended target, i.e., the seeker/guidance control system 6 corrects the course of the projectile 4 while during flight at the intended target. In another embodiment the remote fire control system 8 operates in a semi-automated or fully automated manner without an operator or display using image registration processing. Such a processing system could operate multiple projectile targets simultaneously with the processing hardware and complex processing resident on a base system independent of the projectile 4 and reusable for many projectiles.

The various components of the seeker/guidance control system 6 and the remote fire control system 8 will now be described in more detail with reference to a description of the method of operating the targeting system 2 in order to adjust guidance of the projectile 4 during flight to correct for movement of the intended target or other changes.

As indicated above, the remote fire control system 8 in one example is independent from the seeker/guidance control system 6 and is operated by an operator 12 at a location which is typically some distance away from at least the battlefield 10. Depending on the information/data transmission capabilities of the targeting system 2, the remote fire control system 8 can be located a few yards to hundreds or even thousands of kilometers away from the battlefield 10. The remote fire control system 8 is generally sized so as to be carried by the operator 12 out in the field of operation or can be mounted on any type of vehicle for ease of transportation thereof. The remote fire control system 8 in one example is a console at a base command location.

The remote fire control system 8 includes a processor 16 which is electrically coupled to a display device 18, an input device 20 and a memory unit 22 for the purposes of communicating therewith. The remote fire control system 8 may be powered by an electrical energy supply 24 which can be in the form of an internal power source, such as a battery, and/or in the form of an external power source, such as a generator or some other conventional electrical supply. The processor 16 of the remote fire control system 8 is further connected to a communication link 26 that includes a transmitter and receiver and enables the remote fire control system 8 to communicate wirelessly with the seeker/guidance control system 6 mounted on the projectile 4. In a further embodiment the communication link 26 also wirelessly communicates with a remote imaging device 28, as a number of communication links that enable wireless communication between individual remote systems are known, a further discussion concerning the same will not be provided.

One aspect regarding the wireless communication capabilities, between the remote fire control system 8 and the seeker/guidance control system 6 as well as a remote imaging device 28, is that the communication links of the targeting system 2 include the ability to transmit and receive optical image and/or video data. As noted above, the communication link 26 of the remote fire control system 8 typically communicates wirelessly with a remote imaging device 28. The remote imaging device 28 can be, for example, a satellite, a manned aerial vehicle or an unmanned aerial vehicle. One aspect of the remote imaging device 28 is that it includes the capability of capturing images and/or video of a desired area(s), such as a battlefield 10, and transmitting the information/data of those images and/or videos 30 of the battlefield 10 to at least the remote fire control system 8 of the targeting system 2. In one example the remote imaging device 28 is positioned with respect to the battlefield 10 so as to capture a "birds eye view" or panoramic or plan view of the battlefield 10.

Figure 2:
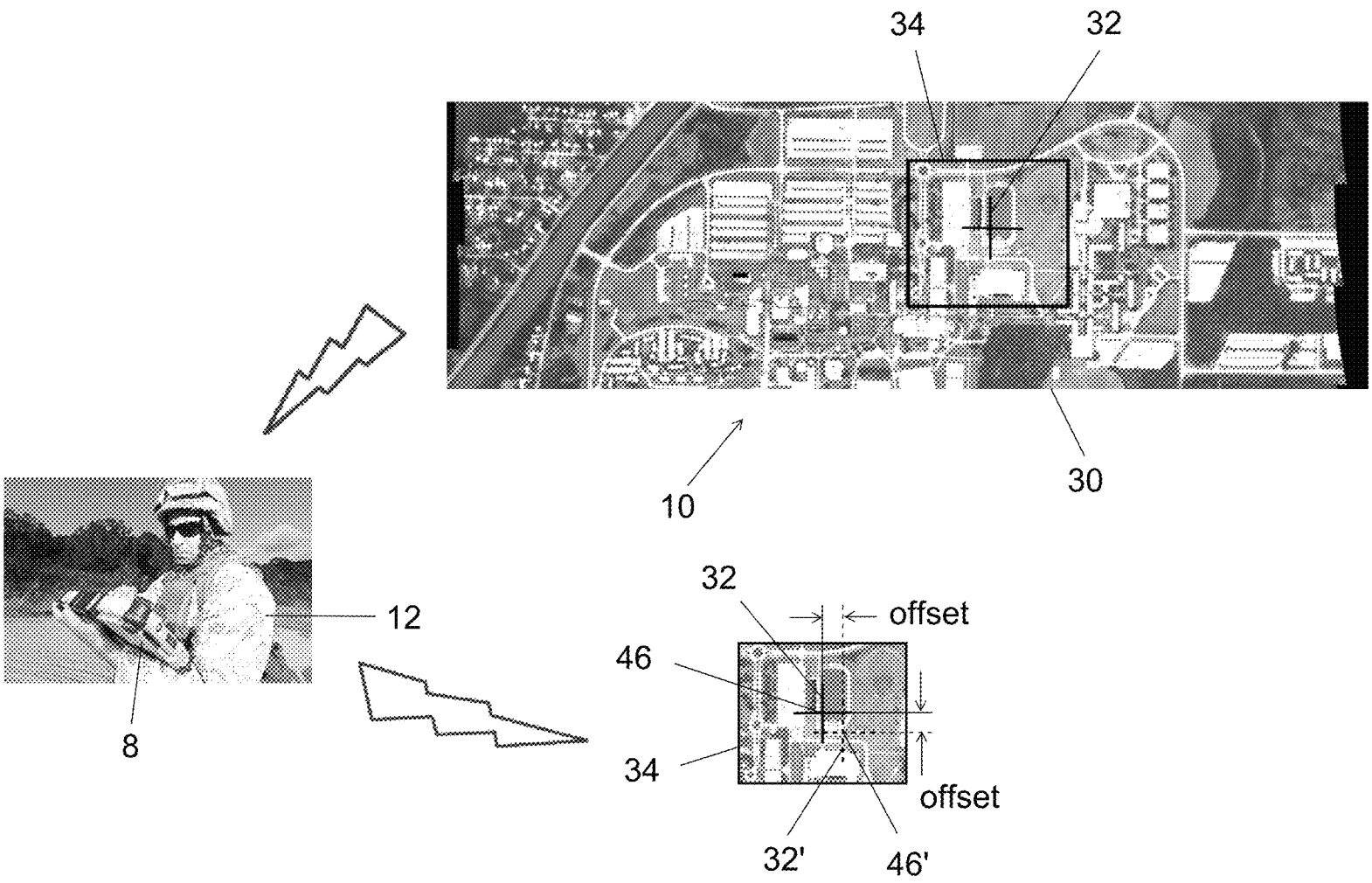
FIG. 2 diagrammatically shows optical images transmitted to and from a remote fire control system according to the disclosure.

Referring to FIG. 1 and FIG. 2, the targeting system 2, the communication link 26 of the remote fire control system 8 first receives information/data for one or more optical images and/or videos 30 of the battlefield 10 from the remote imaging device 28. In one embodiment the information/data of the battlefield 10 is real time information. The optical image and/or video 30 in one example is displayed on the display device 18 which displays the optical image and/or video 30 to allow the operator 12 to view the battlefield 10 and witness events as they occur "on the ground." The display device 18 also enables the operator 12 to view and monitor potential targets or concerns in the battlefield 10. The display device 18 can include, for example, one or more of a liquid crystal display (LCD), a light-emitting diode (LED) display, or an organic light-emitting diode (OLED) display. The type of display device 18, for the remote fire control system 8 enables the operator 12 to clearly view the battlefield 10 and locate or identify one or more potential targets. It is to be appreciated that the targeting system 2 can be utilized with potential targets that are either stationary target, for example buildings, roads, bridges, train tracks and dams, or mobile targets, for example land vehicles, water craft, or people. In one example the projectile 4 is initially provided targeting information and uses the on-board seeker/guidance control system 6 to direct the course and mission of the projectile 4. The remote fire control system 8 is used to provide more accurate designation for the intended target, including change in coordinates if the intended target has moved or if a new target is designated.

In the following discussion, the optical image and/or video 30, shown on the display device 18, will be referred to as a survey image of the battlefield 10. The survey image 30 of the battlefield 10 is generally a high-definition image that shows a relatively large area or overview of the battlefield 10 and results in a relatively large file size, i.e., the amount of information/data (bytes) that the file contains. It is to be appreciated that the geographical area of the battlefield 10, captured in the survey image 30, as well as the resolution of the survey image 30 can depend on a number of different factors including the capabilities of the remote imaging device 28 for both capturing the optical image and/or video 30 and transmitting the same to the remote fire control system 8.

When the operator 12 of the remote fire control system 8 selects a potential target located within the survey image 30 of the battlefield 10, the operator 12 can then use the input device 20 to identify, mark or designate, the potential target. The input device 20 of the remote fire control system 8 may comprise, for example, one or more of a keypad, pushbuttons and/or a joystick which are pressed or otherwise manipulated by the operator 12 in order to move and/or position a marker 32, electronic indicator or some other screen marker relative to the survey image 30. For example, when the desired intended target is chosen by the operator 12, the operator 12 will position the marker 32, via the input device 20, on top of the desired target and identify, mark or otherwise designate the intended target. According to one embodiment, the display device 18 and the input device 20 can be combined as a touchscreen or a touch sensitive display which enables the operator 12 to merely tap the touchscreen with his/her finger or a stylus so as to position the marker 32 and thereby identify, mark or designate intended impact point on the intended target within the survey image 30.

Once the intended target within the survey image 30 is identified, marked or designated, the processor 16 of the remote fire control system 8 analyses the survey image 30 and identifies the precise location coordinates 32, e.g., pixel or pixels, in the survey image 30 that have been identified, marked or designated as the intended target by positioning of the marker 32 on the intended target. It should be understood that the location coordinates 32 in the survey image 30 and the position of the marker 32 in the survey image 30 both correspond to the precise geographic location of the intended target in the battlefield 10 at the time the operator 12 identifies, marks or designates the intended target using input device 20 of the remote fire control system 8. While the intended target may have been initially established upon projectile launch, the location of the target may be updated as noted herein by the targeting system 2, as this is the first time that the intended target has been selected by the operator 12, the location coordinates and the position of the marker in the survey image 30 are referred to hereinafter as the initial location coordinates 32 and, as stated above, correspond to the precise geographic location of the intended target at the time of identifying, marking or designating.

In addition to identifying the initial location coordinates 32 of the intended target, the processor 16 of the remote fire control system 8 in one example further defines a reference image 34 based on the initial location coordinates 32 in the survey image 30, i.e., the position of the marker in the survey image 30. The reference image 34 is defined as an area surrounding the initial location coordinates 32 of the intended target within the survey image 30 of the battlefield 10. In one example the area of the reference image 34 corresponds to an array of pixels within the survey image 30 of the battlefield 10 surrounding the initial location coordinates 32 of the intended target. In another example the area of the reference image 34 corresponds to an actual distance surrounding the initial location coordinates 32. The reference image 34 identifies a location within the survey image 30 of the battlefield 10 that immediately surrounds the identified, marked or designated intended target, and thus the pixel array of the reference image 34 is typically smaller in size than the array of pixels that make up the survey image 30 of the battlefield 10. In other words, as diagrammatically shown in FIG. 2, it is to be appreciated that the relative file size of the reference image 34, i.e., the amount of information/data (bytes) that the reference image 34 contains, is much smaller than the file size of the survey image 30.

It is to be noted that the actual size of the reference image 34 can depend on a number of factors. For example, if it is known that the intended target is immobile, the relative size of the reference image 34 may be fairly small as it does not need to account for any anticipated movement of the intended target within the area contained within the reference image 34. However, even if the intended target is immobile, if the stationary intended target is surrounded by a number of similarly shaped objects, when viewed from above, such as number of identically shaped, oriented and sized structures, then the relative size of the reference image 34 may be larger in order to ensure correct identification of the intended target by the seeker/guidance control system 6 of the projectile 4, as described below. In the manner also described below, the reference image 34 is to be used by the seeker/guidance control system 6 to assist with initially orienting the projectile 4 subsequent to launch thereof and guiding the projectile 4 while traveling toward the intended target located within the battlefield 10.

In one embodiment, subsequent to defining the reference image 34 and identifying the initial location coordinates 32 of the intended target, the communication link 26 of the remote fire control system 8 then transmits both the reference image 34 and the initial location coordinates 32 of the intended target to the seeker/guidance control system 6 mounted on the projectile 4. Also the reference image 34 and the initial location coordinates 32 of the intended target can be stored in a suitable computer accessible memory unit 22, e.g., a RAM, a ROM and a Flash memory for later consideration and analysis.

As shown in FIG. 1, according to one example the seeker/guidance control system 6 mounted on the projectile 4 includes an onboard communication link 36 which receives at least the reference image 34 and the initial location coordinates 32 of the intended transmitted thereto by the remote fire control system 8. It is to be appreciated that the information/data can be transmitted back and fourth, via communication links, between the remote fire control system and the imaging device as well as the seeker/guidance control system as illustrated by arrows in FIG. 2.

The onboard communication link 36 transmits the information/data to an onboard processor 38 for use in the manner which will be described herein in further detail. Once the reference image 34 and the initial location coordinates 32 are received in the seeker/guidance control system 6, the projectile 4 is thereby ready for launch. The projectile, with the loaded information/data, is then launched and guided toward the battlefield 10.

The seeker/guidance control system 6 has an image based seeker 40 equipped with seeker optics 42 and detector arrays 44 that are positioned adjacent a leading end of the projectile 4 so as to provide the image based seeker 40 with a generally forward and downward field of view of the terrain as the projectile 4 travels toward the reference image 34 located within the battlefield 10. The seeker optics 42 are designed to capture and project beams of visible light toward one or more optical detector arrays 44 which, in turn, convert the incident light into electrical signals that are used for measurement and analysis purposes. In this way, optical images of the battlefield 10 can be transformed into electrical signatures via pixel arrays of the one or more optical detector arrays 44. The electrical signatures are transmitted to the onboard processor 38 and analyzed together with the reference image 34 and initial location coordinates 32. From these inputs, the onboard processor 38 can recognize the battlefield 10 and determine an initial aim point 46 of the intended target with respect to the reference image 34. It is to be understood that the initial aim point 46 determined by the onboard processor 38 corresponds to the initial location coordinates 32 of the intended target.

The onboard processor 38 is electrically coupled to and communicates with a guidance control system 48 of the seeker/guidance control system 6. Based at least on the analysis of the electrical signals from the one or more optical detector arrays 44, the onboard processor 38 transmits guidance signals to actuators 50 of the guidance control system 48 so as to control the adjustable wings or canards 52 of the projectile 4 and enable left/right and up/down steering adjustments of the projectile 4 to occur and thereby control guidance of the projectile 4 toward the initial aim point 46 of the intended target.

The targeting system 2, as described above, facilitates simple prosecution of a stationary target. If the intended target is stationary, typically the operator 12 may only need to identify, mark or designate the location coordinates 32 of the intended target once in the reference image 34. It is to be appreciated that in the case of a stationary target, the initial location coordinates 32 of the intended target may not change as the projectile 4 is guided toward the stationary intended target and the targeting system may not require the operator 12 to identify the location coordinates 32 of the intended target.

Figure 3:
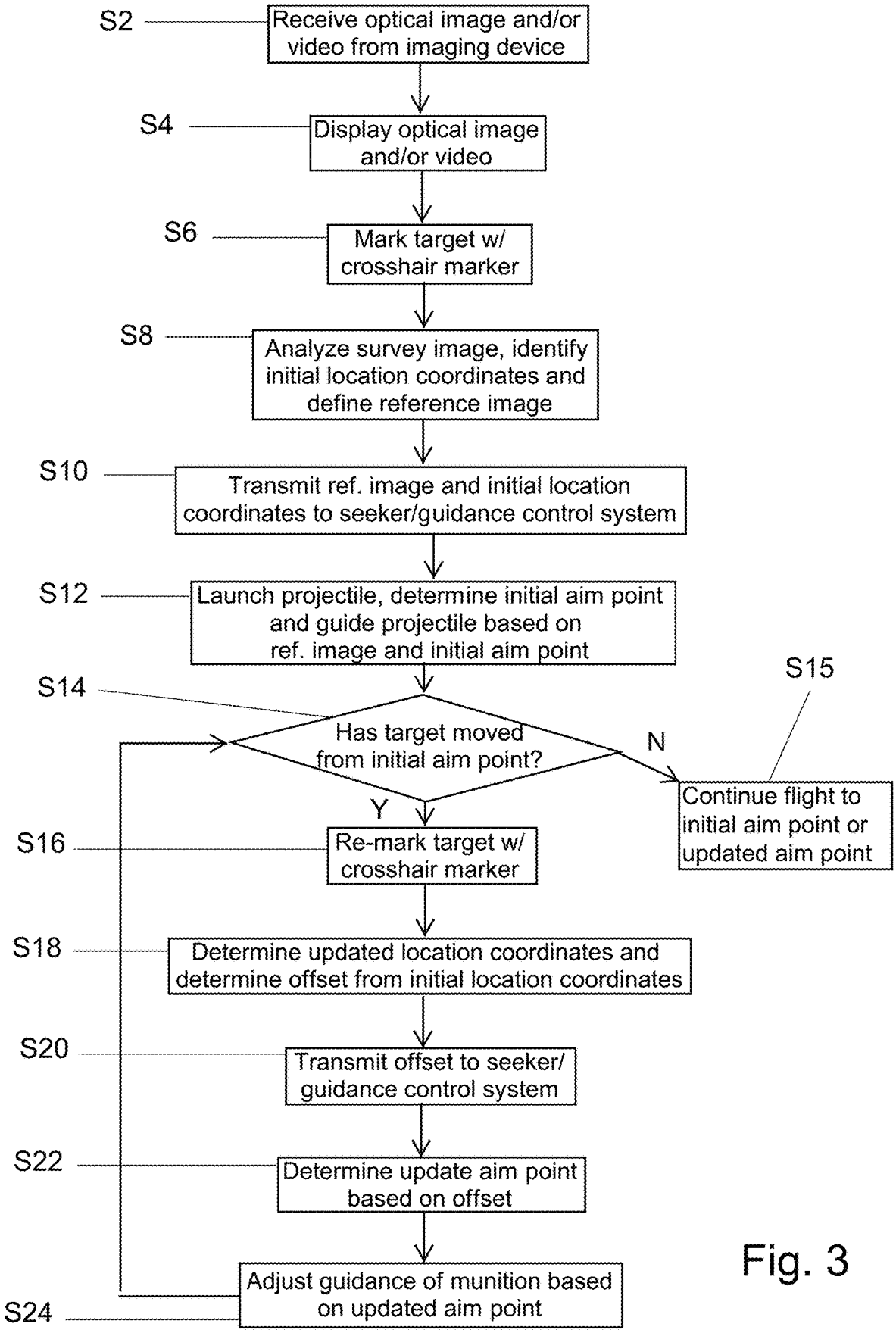
FIG. 3 is a flowchart illustrating a method of correcting guidance of a projectile mid-course with the image based targeting system according to the disclosure.

In one example, when utilizing the targeting system 2, according to the disclosure to launch a projectile 4 at a moving or potentially movable intended target, the remote fire control system 8 facilitates adjusting or modifying of the initial aim point 46 of the intended target during the flight of the projectile 4. That is, once the reference image 34 and the initial location coordinates 32 of the intended target are transmitted to the seeker/guidance control system 6 and, thereafter, the projectile 4 is launched and traveling toward the moving or potentially movable intended target, the remote fire control system 8 enables the operator 12 to periodically update or revise the location coordinates of the intended target, as required or necessary, as shown in FIGS. 2 and 3. For example, if the moving or potentially movable intended target moves after the projectile 4 is launched, but while the projectile 4 is traveling toward the moving or potentially movable intended target, due to such movement the initial aim point on the intended target will no longer be accurate. As a result, by the time the projectile 4 reaches the initial aim point 46, i.e., the initial location coordinates 32, the intended target in the reference image 34, it is likely that the projectile 4 will completely miss the intended target unless the seeker/guidance control system 6 on the projectile 4 is provided with updated location coordinates.

The targeting system 2, according to the disclosure, will now be described further with reference the steps of tracking a moving intended target and updating or revising the initial aim point 46 of the intended target, utilized by the onboard seeker/guidance control system 6, in order to alter the course flight path of the projectile 4 and thereby guide the projectile 4 to the updated or revised aim point of the intended target. Initially, the targeting system 2 determines whether or not the intended target has moved from the initial aim point 46. This is accomplished by recognition of a new marker 32' being input by the operator 12 using the input device 20 of the remote fire control system 8.

Basically, in the case of a mobile intended target, as the intended target moves within the reference image 34, e.g., the intended target moves away from its initial location at which the operator 12 first marked or designated as the aim point of the intended target, i.e., the initial location coordinates 32 in the reference image 34, the initial aim point 46 will need to be updated or adjusted in the seeker/guidance control system 6 so that flight path corrections can be made, by the guidance control system 48, to guide the projectile 4 to new or updated location coordinates 32' of the intended target in the reference image 34. If no new or updated location coordinates 32' are input into the fire control system 8, then the onboard seeker/guidance control system 6 will continue to guide the projectile 4 along its original course to the initial aim point 32 and the intended target.

However, if new or updated location coordinates 32' are input into the fire control system 8, then the course of the projectile 4 will need to be corrected. Generally the steps for correcting, adjusting or modifying the flight path of the projectile 4, following launch thereof, continue from the above described steps in which the onboard processor 38 analyses the reference image 34 and the initial location coordinates 32 of the intended target, and issues guidance signals to the adjustable wings or canards 52 so as to guide the projectile 4 toward the initial aim point 46. Following launch, while the projectile 4 is being guided toward the initial aim point 46 of the intended target, the operator 12 typically continues to visually track the current location of intended target within the reference image 34 using the display device 18 of the remote fire control system 8. If the intended target moves away from its initial location, which is identified by initial location coordinates 32, then the operator 12 will mark the current location of the intended target with the reference image 34 of the survey image 30 with a new marker 32' using the input device 20 to thereby update or revise the initial location coordinates 32. These updated or revised location coordinates 32' of the pixel or pixels identified, as the current location of the intended target, are then transmitted to the seeker/guidance control system 6 of the projectile 4, via the communication link 26 of the remote fire control system 8. It is to be appreciated that the operator 12 typically visually tracks and can repeatedly mark any movement of the intended target and repeatedly transmit updated or revised location coordinates 32' of the intended target to the seeker/guidance control system 6 until the projectile 4 eventually strikes the intended target.

Based on a number of different factors, such as the flight speed of the projectile 4, the distance between the location at which the projectile 4 was launched and the location of the intended target in the battlefield 10, the operator 12 is provided with a fixed amount of time, from a few second to a few minutes or longer, during which the operator 12 is able to visually track and repeatedly update or revise the location coordinates 32' of the intended target and thus the aim point until the projectile 4 actually strikes the intended target. As such the number of times that the location coordinates, i.e., the aim point, can be updated or revised in the seeker/guidance control system 6 can also vary. The number of times that the aim point can be updated can also vary based upon considerations such as, the processing speed of the processors 16, 38 in the targeting system 2, the performance of the remote fire control system 8 and the seeker/guidance control system 6, the size or amount of information being transmitted from the remote fire control system 8 to the seeker/guidance control system 6, the available bandwidth for transmitting this information, the transmission distance between the remote fire control system 8 and the seeker/guidance control system 6, etc.

For the sake of brevity, in the following description of the method of using the targeting system 2, the aim point of the intended target will only be updated or revised one time, however, it is to be understood that the aim point of the intended target can be updated, according to the method, any number of times. In sum, according to the description, after the initial location coordinates 32 are transmitted to the seeker/guidance control system 6 for use in determining an initial aim point 46 and guidance of the projectile 4 to the intended target, updated or revised location coordinates 32' will be transmitted from the remote fire control system 8 to the seeker/guidance control system 6 only once before the projectile 4 prosecutes the intended target.

Referring to FIG. 3, a remote imaging device captures images at some timeframe of a battlefield. A remote fire control system received the battlefield image information/data S2 that is processed to determine an intended target. In one example the image information/data is presented to a user on a display S4 and the user designates the intended target or otherwise marks the intended target S6 and obtains the location coordinates and in one example define a reference image about the intended target S8. In another embodiment, an image registration algorithm analyzes the image information/data and identifies the location coordinates automatically. For example, the instructions might be to target a bridge on the right side of a named river and the image registration would identify the intended target.

The location coordinates are transmitted to the seeker/guidance control system S10 and may include at least one of the reference image or the image information/data which is provided to the projectile prior to launch. The projectile is launched S12 using the location coordinates and an initial aim point such that the seeker/guidance control system controls the actuators and proceeds towards the reference image and location coordinates. The remote imaging device is designed to obtain images of the battlefield that are provided to the remote fire control system to determine whether the intended target has moved S14. If the intended target has not moved, the projectile continues along the latest aim point S15.

Following transmission of the reference image 34 and the initial location coordinates 32 of the intended target to the seeker/guidance control system 6 and launch of the projectile 4, and while the projectile 4 is generally being guided toward intended target, i.e, the initial aim point 46, the operator 12, in step S16, can re-mark, update or revise the location coordinates of the intended target displayed on the display device 18 using the input device 20. The processor 16 of the remote fire control system 8 then analyses the updated or revised pixel or pixels, now marked as the updated location coordinates 32' of the intended target with respect to the reference image 34. By comparing the initial location coordinates 32 of the pixel or pixels with the updated or revised location coordinates 32' of the pixel or pixels, the processor 16 of the remote fire control system 8 is able to determine, in step S18, an "offset" between the new and the initial location coordinates of the intended target within the reference image 34.

In an advantageous manner, the communication link 26 in the remote fire control system 8 then transmits, in step S20, only the offset of the location coordinates to the seeker/guidance control system 6 of the projectile 4. As a result of only transmitting the offset of the location coordinates to the seeker/guidance control system 6, the bandwidth required for transmission of this information is greatly reduced and, in a corresponding manner, the onboard communication link 36 of the seeker/guidance control system 6 does need not be an expensive, high-performance type of communication link.

Upon receiving the offset of the location coordinates from the remote fire control system 8, the onboard processor 38, in step S22, is able to shift the location of the initial aim point 46 of the intended target in the reference image 34 to an updated or revised aim point 46' of the intended target in the reference image 34. In other words, the onboard processor 38 changes or modifies the initial aim point 46, in the reference image 34, to an updated or revised aim point 46', in view of the offset information received from the remote fire control system 8. It is to be appreciated that the offset information and corresponding changes in the position of the aim point are based on the movement of the intended target within the reference image 34 from its initial position. It has been found that a low rate of pixel shifts, on the order of 10 to 20 Hz, is more than adequate to precisely guide the projectile 4 at the intended target which is moving.

Based on the determined offset information or rather the location changes of the aim point from the initial aim point 46 to the updated or revised aim point 46', the onboard processor 38 transmits updated guidance signals to the guidance control system 48 which accordingly controls, in step S24, the adjustable wings or canards 52 so as to correct, adjust or modify the flight path of the projectile 4 toward the updated or revised aim point 46' of the intended target. Following this step, the method returns to step S14 to determine whether or not the intended target has again moved from the updated or revised aim point 46'. This is accomplished by recognition of a new marker 32' input by the operator 12 using the input device 20 of the remote fire control system 8. If the updated or revised location coordinates 32' have not been updated or revised, the projectile 4 will continue flight along its current course to toward the last updated aim point 46' of the intended target.

Again, it is to be appreciated that the aim point 46, 46' of the intended target and thus guidance of the projectile 4 can be updated repeatedly until the projectile 4 reaches the intended target or until the projectile 4 is so close to the intended target that further changes or modifications of the flight path would not effectively alter the flight path of the projectile 4 before it reaches the intended target.

In an advantageous manner since the targeting system 2 utilizes a smaller reference image 34, lower cost Inertial Measurement Units (IMUs) are sufficient for achieving the desired results. Because the targeting system 2 according to the invention comprises described communication links, the processor which carries out majority of the necessary analysis and calculations associated with the targeting system 2 can remain with the remote fire control system 8 and be reused indefinitely, thereby reducing the associated costs related to mounting a high-performance processor on the projectile 4 for a single use. Likewise, since the remote fire control system 8 is separate from the seeker/guidance control system 6 mounted on the projectile 4, it is possible to readily enhance and/or update the targeting system 2 as advances in the associated technologies become available. In addition, the communication link 26 of the remote fire control system 8 can communicate with other remote fire control systems thereby providing the opportunity to coordinate operations of multiple projectiles 4. It is to be further appreciated that ATR can be applied to the remote fire control system 8. In one example the processor of the 16 of the remote fire control system 8 is a high performance processor having the capability of running complex algorithms of ATR software thereby providing the fire control system 8 with the capability of identifying and tracking an intended target as it moves as well as determining the offsets of the location coordinates which are then transmitted to the onboard seeker/guidance control system 6 in the previously described manner. In a further example the remote fire control system 8 can have ATR capabilities, which after the operator 12 identifies, marks or designates an intended target, function to track the intended target as it moves. As the ATR system tracks the intended target, the offsets of the location coordinates can be repeatedly or continually transmitted to the onboard seeker/guidance control system 6 in the manner described above.

While various embodiments of the disclosure have been described in detail, it is apparent that various modifications and alterations of those embodiments will occur to and be readily apparent to those skilled in the art. However, it is to be expressly understood that such modifications and alterations are within the scope and spirit of the disclosure, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Wherefore, I claim:

1. A targeting system for guidance correction of a projectile along a flight path toward an intended target, the targeting system comprising:

a seeker/guidance control system coupled to the projectile, the seeker/guidance control system controlling guidance of the projectile along the flight path, the seeker/guidance control system being electrically coupled to an onboard communication link for receiving information;

a remote imaging device which captures and transmits a survey image of a battlefield region about the intended target, and the remote imaging device being independent of and remote from the projectile; and a fire control system comprising a transmit and receive communication link electrically coupled to an input device, a display device and a processor, the fire control system being independent of and remote from the remote imaging device and the projectile, wherein the communication link of the fire control system facilitates receiving the survey image, the input device facilitates selecting and identifying initial location coordinates of the intended target within the survey image, in the form of a pixel or pixels, and the processor defines a border of a reference image that surrounds the initial location coordinates, the reference image being a subset of the survey image;

wherein the communication link of the fire control system facilitates transmitting the reference image and the initial location coordinates of the intended target before launch of the projectile to the onboard communication link of the seeker/guidance control system of the projectile for controlling guidance of the projectile to the intended target.

2. The targeting system according to claim 1, wherein the input device of the fire control system facilitates input of revised location coordinates of the intended target if the intended target moves from the initial location coordinates, and the communication link of the fire control system transmits the revised location coordinates of the intended target to the seeker/guidance control system which adjusts guidance of the projectile to the revised location coordinates.

3. The targeting system according to claim 2, wherein the processor of the fire control system is configured to determine a location offset by either comparing the initial location coordinates to the revised location coordinates of the intended target or the revised location coordinates to subsequent revised location coordinates of the intended target, and the communication link of the fire control system transmitting only the location offset to the seeker/guidance system, and the seeker/guidance control system being configured to adjust guidance of the projectile based on the location offset.

4. The targeting system according to claim 2, wherein the communication link of the fire control system transmits the revised location coordinates of the intended target to the seeker/guidance control system subsequent to the launch of the projectile.

5. The targeting system according to claim 1, wherein the processor of the fire control system is configured to determine an aim point of the projectile based on the initial location coordinates of the intended target within the reference image and guide, via the seeker/guidance control system, the projectile along the flight path toward the intended target based on the aim point.

6. The targeting system according to claim 1, further comprising a second seeker/guidance system mounted on a second projectile, and the fire control system being operable with the second seeker/guidance system mounted on the second projectile for correcting guidance of the second projectile along its flight path toward a second intended target.

7. The targeting system according to claim 1, wherein the survey image is made up of a first array of pixels and the reference image is defined by the processor in the fire control system as a second array of pixels that is smaller in size than the first array of pixels of the survey image to facilitate rapid transmission of the reference image to the seeker/guidance system, and the second array of pixels defines a geographic area within the survey image.

8. The targeting system according to claim 1, wherein the input device of the fire control system is configured to repeatedly input revised location coordinates of the intended target to continually compensate for movement of the intended target within the reference image, and the communication link of the fire control system is configured to transmit each of the revised location coordinates of the intended target to the seeker/guidance control system for guidance of the projectile to the revised location coordinates of the intended target.

9. The targeting system according to claim 1, wherein the display device of the fire control system is a touch screen which displays the survey image, the survey image is a video showing the intended target within a geographic area of the survey image, the input device contacting the touch screen for inputting revised location coordinates of the intended target as the intended target moves within the survey image with respect to the initial location coordinates.

10. The targeting system according to claim 9, wherein the fire control system comprises a memory unit in which the processor of the fire control system stores the defined reference image and the initial location coordinates of the intended target, the processor retrieves the initial location coordinates of the intended target upon input of the revised location coordinates, the processor compares the initial location coordinates with the revised location coordinates of the intended target to determine a location offset with the location offset corresponding to a change of aim point of the projectile.

11. The targeting system according to claim 1, wherein the survey image corresponds to a geographic area of the battlefield region and the reference image corresponds to a defined smaller portion of the geographic area of the battlefield region, and the border of the reference image surrounds the initial location coordinates at a defined distance away from the initial location coordinates of the intended target.

12. A method of correcting a flight path of a projectile toward an intended target with a targeting system, the method comprising:

mounting a seeker/guidance control system of the targeting system on the projectile, controlling guidance of the projectile along the flight path toward the intended target with the seeker/guidance control system, and electrically coupling the seeker/guidance control system to an onboard communication link for receiving information;

providing the targeting system with a fire control system having a communication link electrically coupled to a display device, an input device and a processor;

capturing, with a remote imaging device, a survey image in which the intended target is located, the remote imaging device being independent of and remote from the projectile and the fire control system, and transmitting the survey image from the remote imaging device to the fire control system;

receiving, via the communication link of the fire control system, the survey image in which the intended target is located, from the remote imaging device, and displaying the survey image on the display device;

marking on the survey image, via the input device, initial location coordinates of the intended target, in the form of a pixel or pixels, and defining, with the processor, borders of a reference image that surround the initial location coordinates of the intended target such that the reference image is a subset of the survey image;

transmitting, via the communication link of the fire control system, the reference image and the initial location coordinates of the intended target to the seeker/guidance control system of the projectile, prior to launch of the projectile, for facilitating guidance of the projectile to an initial aim point of the projectile;

launching the projectile with the fire control system and guiding the projectile with the seeker/guidance control system toward the initial location coordinates;

displaying, on the display device of the fire control system, further survey images captured and transmitted from the remote imaging device; and marking on the further survey images, via the input device of the fire control system, revised location coordinates of the intended target to compensate for any movement or change in position of the intended target within the reference image, and transmitting, via the communication link of the fire control system, only the revised location coordinates of the intended target to the seeker/guidance control system of the projectile while the projectile is in flight and thereafter guiding, via the seeker/guidance control system, the projectile to a revised aim point of the projectile at the intended target.

13. The method according to claim 12, further comprising determining the initial aim point of the projectile with respect to the reference image with an onboard processor of the seeker/guidance control system of the projectile based on the initial location coordinates of the intended target within the reference image, and guiding, via the seeker/guidance control system, the projectile along the flight path toward the intended target based on the determined initial aim point.

14. The method according to claim 13, further comprising determining, with the processor of the fire control system, a location offset by comparing the initial location coordinates of the intended target to the revised location coordinates of the intended target, and transmitting, via the communication link of the fire control system transmitting, only the location offset to the seeker/guidance system, and applying, via the onboard processor of the seeker/guidance control system, the location offset to the initial aim point of the projectile for determining the revised aim point of the projectile.

15. The method according to claim 12, further comprising mounting a further seeker/guidance system on another projectile, and controlling guidance of the another projectile along a further flight path toward another intended target with the further seeker/guidance control system based on location coordinates of the another intended target transmitted from the fire control system.

16. The method according to claim 12, further comprising defining the reference image in the fire control system as a second array of pixels and defining the survey image as a first array of pixels, and defining the borders of the reference image such that the second array of pixels is a subset of the first array of pixels, and the second array of pixels being smaller in size than a size of the first array of pixels to facilitate faster relative transmission of the reference image to the seeker/guidance system.

17. A targeting system for a projectile, the targeting system comprising:

a seeker/guidance control system mounted to the projectile, the seeker/guidance control system comprising a seeker, a plurality of actuators and at least one processor coupled to memory, the memory having instructions that when executed by the processor control the actuators and guide the projectile to an intended target;

a remote imaging device which is independent of and remote from the projectile, the remote imaging device has a communications unit which captures and transmits one or more survey images of a battlefield region in which the intended target is located; and a remote fire control system comprising a communication link and at least one processor, the remote fire control system is independent of and remote from the projectile and the remote image capturing device, the communications link is configured to receive the survey images from the remote imaging device, the processor is coupled to memory, the memory having instructions that when executed by the processor identify initial location coordinates of the intended target and define a reference image in which the intended target is located based on the initial location coordinates, a border of the reference image is defined such that the reference image is a subset of the survey image, the communications link of the remote fire control system is configured to transmit the reference image and the initial location coordinates to the seeker/guidance control system prior to launch of the projectile.

18. The targeting system according to claim 17, wherein the remote fire control system performs image registration of the intended target in the survey images and identifies updated location coordinates of the intended target when the intended target moves within the reference image from the initial location coordinates, and the communications link of the remote fire control system is configured to transmit only the updated location coordinates once the projectile is in flight.

19. The targeting system according to claim 17, wherein the remote fire control system is configured to identify the initial and the updated location coordinates for more than one projectile.

20. The targeting system according to claim 17, wherein the memory of the remote fire control system provides automated target recognition capabilities such that the memory of the remote fire control system has instructions that when executed by the processor of the remote fire control system recognize the intended target and track movement of the intended target.

* * * * *